US006446973B1

(12) United States Patent
Pham

(10) Patent No.: US 6,446,973 B1
(45) Date of Patent: Sep. 10, 2002

(54) THREE OF A KIND CARD GAME AND METHOD OF PLAYING THE SAME

(76) Inventor: Bryan E. Pham, 111 Ninth St. North, Brigantine, NJ (US) 08203

( * ) Notice: Subject to any disclaimer, the term of this patent is extended or adjusted under 35 U.S.C. 154(b) by 7 days.

(21) Appl. No.: 09/584,849

(22) Filed: Jun. 1, 2000

(51) Int. Cl.[7] ..... A63F 3/00

(52) U.S. Cl. ..... 273/306; 273/274; 273/292; 273/303; 273/309

(58) Field of Search ..... 273/236, 292, 273/274, 308, 309

(56) References Cited

U.S. PATENT DOCUMENTS 4,588,193 A * 5/1986 Winston ..... 273/304
5,294,128 A * 3/1994 Marquez ..... 273/292
5,314,194 A * 5/1994 Wolf ..... 273/292
5,366,228 A 11/1994 Kangsanaraks
5,496,038 A 3/1996 Kangsanaraks
5,678,821 A 10/1997 Hedman
5,785,606 A 7/1998 Marquez
5,863,042 A 1/1999 Lo
5,901,958 A 5/1999 Andrews
5,951,012 A * 9/1999 Feola ..... 273/292
6,098,984 A * 8/2000 Moore, Jr. ..... 273/292

* cited by examiner

*Primary Examiner*—Benjamin H. Layno
*Assistant Examiner*—Dolores Collins
(74) *Attorney, Agent, or Firm*—Norman E. Lehrer

(57) ABSTRACT

The card game of the present invention utilizes a deck of 45 cards which may resemble a standard deck of playing cards. The deck includes 15 sets of three similar cards ranging from two through ace including jacks, queens and kings. In addition, the deck includes three jokers and three cards referred to as dot cards. The numbered cards have a value equal to the number thereon while the picture cards have a value of zero. Jokers may have a value of zero or one. The three dot cards have a value of three, six or nine depending on the number of dots on the card. The game is played by dealing six cards to each of six players or player spots and six cards to the dealer. Each player, including the dealer, then separates his cards into a high hand and a low hand in accordance with a predetermined hierarchy or ranking of the hands. In order to win, each of the player's high and low hands must beat the dealer's high and low hands.

2 Claims, 2 Drawing Sheets

THREE OF A KIND CARD GAME AND METHOD OF PLAYING THE SAME

BACKGROUND OF THE INVENTION

The present invention is directed toward a new card game which, in some aspects, is similar to the game of Pai Gow Poker and, in other aspects is similar to the game of Baccarat. The invention relates to a new deck of cards and to a new method of play utilizing the novel cards, the intent of which is to make the game more interesting and to increase revenues for casinos.

Although the game of Pai Gow Poker, frequently referred to as Asian Poker, has been around for many years, it has only recently gained wide spread acceptance in gambling casinos throughout the United States. As is well known in the art, the game is played with either tiles or with a standard deck of 52 playing cards. In some versions of the game, a joker is also utilized although the same normally can be used to represent only a limited number of cards such as an ace or as part of a straight or flush. Rankings in Pai Gow Poker are substantially the same as rankings in other types of poker games.

Pai Gow Poker is typically played in a casino at a table much like that utilized for Blackjack or Baccarat or the like. That is, there is a dealer position and six player positions equally spaced around the perimeter of the table. At each player position, there are normally markings or indicia for the dealer's high and low hands and a spot for each player to place his or her ante or bet.

The game is typically started by each player placing a bet. The dealer then deals seven cards to himself and to each of the six player positions. Each player, including the dealer, then forms two hands from his holding of seven cards. One hand, referred to as the low hand, consists of two of the dealt cards. The other hand, referred to as the high hand, consists of the remaining five cards that were dealt to that player.

The only requirement in forming the high and low hands is that the low hand must be of a lower rank than the high hand. In conventional Pai Gow, the ranking of the hands is similar to traditional poker with the exception as pointed out above that the joker can be used to represent an ace or to represent any one card of either a straight or a flush. Thus, the highest possible hand is five aces.

If the player's low hand and high hand are higher in rank than the low and high hand of the dealer or banker, the player is a winner arid the banker loses. However, if the dealer or banker's hands are higher than,the player's, the player is a loser and the banker wins. The banker's hand is normally considered to be the winner in the event of a tie.

If the player's low hand is of a higher rank than the banker's low hand but the player's high hand is of a lower rank than the banker's high hand, neither wins and there is considered to be a push. Similarly, a push exists when a player's low hand is of a lower rank than the banker's low hand and the player's high hand is of a higher rank of the banker's high hand. There is, therefore, no winner when a push exists.

Although the conventional game of Pai Gow can be exciting, it can be difficult to learn. And even those familiar with the game can become bored with the same as it can become routine. The game, therefore, is not normally a big money maker for casinos.

Baccarat is another popular table game played in casinos or gaming establishments. Baccarat also uses a standard deck of 52 playing cards and is usually dealt from a shoe having multiple decks that have been shuffled together prior to the beginning of play.

The object of the game of Baccarat is for the bettor to successfully wager on whether the bank's hand or the player's hand is going to win. The bettor receives even money for his wager if he selects the winning hand and loses his wager if he selects the losing hand. In a conventional Baccarat game, each bettor first makes a wager on whether the bank's hand or the player's hand will win. After all wagers are made, two cards are dealt from the shoe to the bank position and two cards are dealt from the shoe to the player position on the table layout. The cards are turned face up and the value of the bank hand the player hand is determined, modulo ten. In determining values, aces count as one; kings, queens, jacks and tens count as zero and the other cards count as their respective face value. The suits have no meaning in Baccarat.

The highest hand value in Baccarat is nine. All hand values range from a low of zero to a high of nine. If when the cards are added together, the total of the hand exceeds nine, then the hand value is determined modulo ten. For example, a seven and an eight total fifteen, but the hand value is five. An ace and a nine total ten, but the hand value is zero. Under certain situations in the play of the game, a third card will be dealt. The value of this third card is added to the total of the first two cards and a new hand value is established. Again, if the new hand total exceeds nine, the hand value is determined by subtracting ten from the total of the hand.

While Baccarat is relatively easy to play because of the relative ease in determining the rankings of the hands, it also can become monotonous as there are essentially no decisions to be made by the player. The cards are automatically dealt to each player according to the rules and the winner is determined automatically according to the established rules. The player essentially watches.

There is, therefore, a need for a casino card game that combines the intricacies and mental challenge of Pai Gow with the easy of baccarat. Such a game would encourage the players to play and to play longer which would obviously result in increased revenues for the casino or other gaming establishment.

SUMMARY OF THE INVENTION

The present invention is designed to overcome the deficiencies of the prior art described above. The invention utilizes a deck of 45 cards which may resemble a standard deck of playing cards. The deck includes 15 sets of three similar cards ranging from two through ace including jacks, queens and kings. In addition, the deck includes three jokers and three cards referred to as dot cards. The numbered cards have a value equal to the number thereon while the picture cards have a value of zero. Jokers may have a value of zero or one. The three dot cards have a value of three, six or nine depending on the number of dots on the card. The game is played by dealing six cards to each of six players or player spots and six cards to the dealer. Each player, including the dealer, then separates his cards into a high hand and a low hand in accordance with a predetermined hierarchy or ranking of the hands. In order to win, each of the player's high and low hands must beat the dealer's high and low hands.

BRIEF DESCRIPTION OF THE DRAWINGS

For the purpose of illustrating the invention, there is shown in the accompanying drawing one form which is presently preferred; it being understood that the invention is not intended to be limited to the precise arrangements and instrumentalities shown.

DETAILED DESCRIPTION OF THE PREFERRED EMBODIMENT

Figure 2:
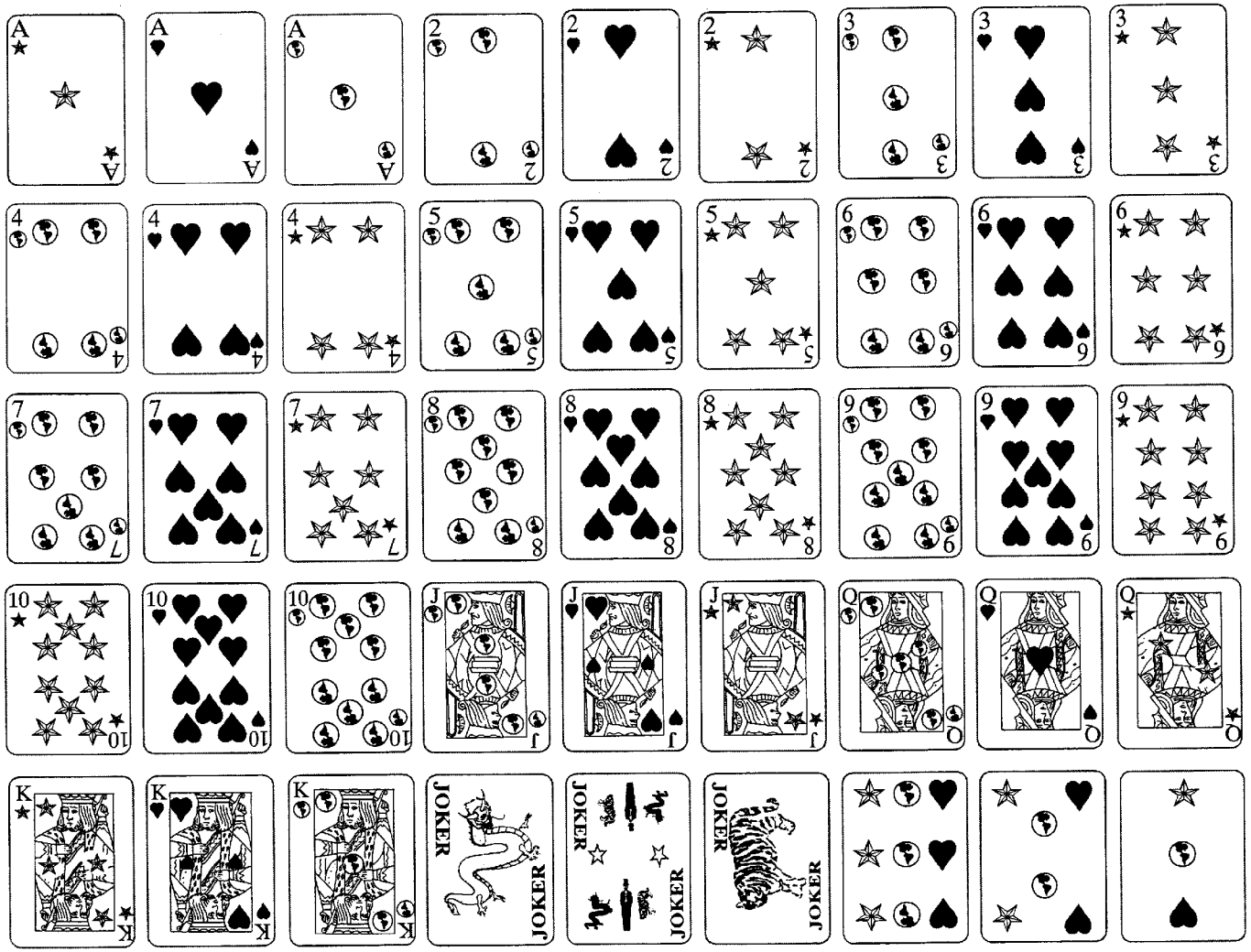
FIG. 2 is a plan view of the playing cards used to play the game of the present invention.

As shown in FIG. 2, the present game is played with a deck of 45 cards. The deck is comprised of 15 sets of three similar cards ranging from the deuce to the ace plus three jokers and three cards which may have dots or other specific symbols thereon. The majority of the cards will resemble more conventional playing cards. For example, there will be three deuces, three three's, etc. up to three tens representing the numbered cards, nine picture cards comprised of three jacks, three queens and three kings. Also included will be three aces and three jokers. In addition, the deck will include the three dot cards referred above.

Preferably, the cards will be of three different suits which may be conventional suits such as heart, diamonds, spades or clubs or substantially any other suits such as hearts, stars and some other astrological symbol such as the configuration of the earth or the like. There will, therefore, be a deuce of hearts, a deuce of stars, a deuce of earth etc. and the same will also be true of each of the other cards.

The three dot cards are preferably distinguishable from each other. This can be accomplished by having one of each suit be symbolized on the first card, two of each suit being symbolized on the second card and three of each suit on the third card. Nothing else need appear on these cards.

Each card will have a value. With respect to the numbered cards from ace to nine, the value will be the value of the number. The tens and picture cards will have a value of zero. Jokers may have a value of either zero or one, which ever may be more beneficial to the player. Similarly, the dealer's jokers may have a value of either zero or one, which ever may be more beneficial to the dealer. The three dot cards have a value of three, six or nine depending on the number of dots on the card.

As will become clear hereinafter, during the play of the game it may become necessary to determine point value of a three card hand. This is determined by adding the sum of the three cards together. However, the general rules of baccarat will apply. That is, hands can range only from zero to nine. For example, cards that may total 15 are equal to only five just the same as if the cards totaled only to five. Since a joker may be either a one or a zero, joker+8+10=9, just as joker+joker+8=9.

Figure 1:
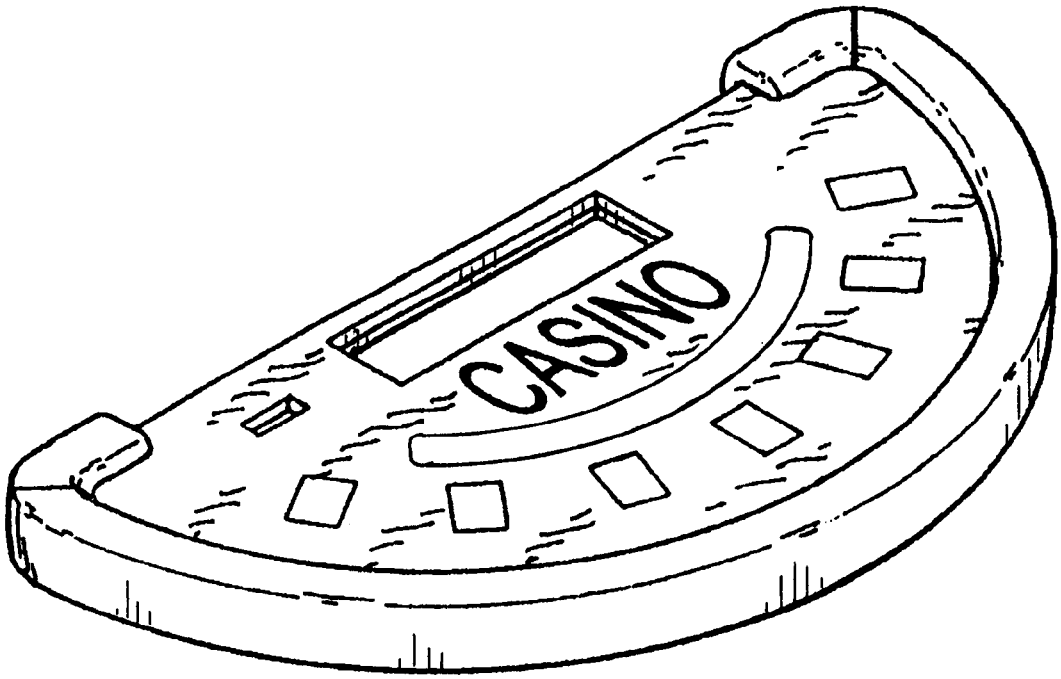
FIG. 1 is a plan view of a gaming table top upon which the game of the present invention can be played.

The game is preferably played at a gaming table such as shown in FIG. 1 which may closely resemble a blackjack or baccarat table. The table would have six player positions and a dealer's position. After the cards are shuffled and a wager is placed by each of the players, the cards are dealt. The first player to receive cards is preferably determined by throwing three dice. The seven positions around the table including the dealer position would be numbered 1–7 starting at the dealer. Accordingly, for example, if the three dice total eight or 15, the dealer would receive the first cards. Thereafter, the cards would be dealt around the table in a counterclockwise direction with each player position receiving six cards. This would leave three cards which would be locked up, i.e. discarded into the discard rack. To ensure a proper card count, six cards are dealt to each player position including the dealer whether or not a player has placed a bet at that position. After the cards are dealt, however, cards at the player positions where there are no wagers may be locked up before play continues.

After the cards are dealt, each player separates his or her six cards into two three-card hands: a high hand and a low hand. The hierarchy or ranking of the hands is determined according to a predetermined order which will be explained hereinafter. The dealer then exposes his or her six cards and similarly separates the six cards into two three-card hands. The dealer then exposes each player's hand one at a time in the counter clockwise direction. If the player loses, the wager is taken and the cards are locked up. If the player wins, the cards will remain face up until all players' hands have been read. If the hand is a push, the wager will remain but the cards are locked up. After all hands have been read, the dealer will go back and pay all winning wagers one at a time, picking up the cards after payment has been made.

To win, the player's high hand and low hand must both beat the banker or dealer's high hand and low hand. If only one hand beats the dealer's hand and the other loses, it is considered to be a push and no money is won or lost. If the player loses both hands, the bank or dealer wins and the player loses his or her bet. A tie, that is if one of the player's hand matches one of the dealer's hands, is considered to be a win by the dealer.

The hierarchy or ranking of hands is in accordance with the following chart:

JO JO JO
A A A
K K K
Q Q Q
10 10 10
9 9 9
8 8 8
7 7 7
6 6 6
5 5 5
4 4 4
3 3 3
2 2 2
* * *
K K Q or K K J
K Q Q or K Q J
K J J
Q Q J
Q J J
Point Value of Nine
Point Value of Eight
Point Value of Seven
Point Value of Six
Point Value of Five
Point Value of Four
Point Value of Three
Point Value of Two
Point Value of One
Point Value of Zero As can be seen from the above chart, the highest hands consist of three of a kind. Within that category, three jokers is the highest of the hands which beats three aces which, in turn, beats three kings, etc. The lowest of the three of a kind hands are the three dot cards which are indicated in the chart by the asterisk (*).

The next highest group of hands consists of any three picture cards. When comparing three mixed picture cards to the dealer's possible three mixed picture cards, only the first two highest cards are considered. Thus, K Q J, for example, is equivalent to K Q Q. In this category, and as can be seen, there is only one possibility of a tie with the dealer. That is, a player could be dealt K Q Q while the dealer could be dealt K Q J. As pointed out above, however, ties go to the dealer and, accordingly, the player would have a losing hand.

The third category of hands are according to the point value. Again, as pointed out above, the point value is ranked from zero to nine with nine being the highest utilizing the same rules as Baccarat, i.e. Modulo 10. As a result, a player's point value of zero will always be a losing hand. The very best that this player's hand could do would be to tie the dealer but since ties always go to the dealer, the player would lose.

As with substantially all other table games, after the cards are played and the players are either paid or their bets are collected by the dealer, all of the cards remaining on the table are collected and put into the discharge rack. The cards are then shuffled and, after bets are placed, the cards are dealt and a new hand begins.

The present invention may be embodied in other specific forms without departing from the spirit or essential attributes thereof and accordingly, reference should be made to the appended claims rather than to the, foregoing specification as indicating the scope of the invention.

I claim:

1. A method of playing a game of cards using a deck of only forty-five cards including three each of the following card groups: twos, threes, fours, fives, sixes, sevens, eights, nines, tens, Jacks, Queens, Kings and Aces of three different suits with each card of each group being of a different suit, said deck further including three Jokers and three additional cards having indicia thereon representing the three different suits but with each of the additional cards having a different value from the value of the other additional cards, said method comprising the steps of allowing each of several players the opportunity to place a bet; dealing six cards to each player and to a dealer; giving each player the opportunity of dividing his cards into two hands of three cards each; comparing each player's two hands to the dealer's two hands and determining whether the dealer or player has won based on a predetermined ranking of hands.

2. A deck of cards for playing a card game comprised of only forty-five cards including three each of the following card groups: twos, threes, fours, fives, sixes, sevens, eights, nines, tens, Jacks, Queens, Kings and Aces of three different suits with each card of each group being of a different suit, said deck further including three Jokers and three additional cards having indicia thereon representing the three different suits but with each of the additional cards having a different value from the value of the other additional cards.

* * * * *